US008215918B2

(12) United States Patent
Hwang et al.

(10) Patent No.: US 8,215,918 B2
(45) Date of Patent: Jul. 10, 2012

(54) IMPELLER AND COOLING FAN INCORPORATING THE SAME

(75) Inventors: Ching-Bai Hwang, Taipei Hsien (TW); Zhi-Hui Zhao, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 1228 days.

(21) Appl. No.: 11/967,063

(22) Filed: Dec. 29, 2007

(65) Prior Publication Data

US 2009/0162210 A1 Jun. 25, 2009

(30) Foreign Application Priority Data

Dec. 19, 2007 (CN) ..... 2007 1 0125270

(51) Int. Cl.
*F04D 29/30* (2006.01)

(52) U.S. Cl. ..... 416/231 B; 416/236 R

(58) Field of Classification Search ..... 415/187, 415/195, 196 R, 223 R, 231 R, 231 B, 235, 415/236 R, 237, 500; 416/119
See application file for complete search history.

(56) References Cited

U.S. PATENT DOCUMENTS

| | | | | |
|---|---|---|---|---|
| 1,622,930 | A * | 3/1927 | Von Karman et al. | 416/183 |
| 2,753,808 | A * | 7/1956 | Kluge | 416/183 |
| 6,007,300 | A * | 12/1999 | Saeki et al. | 416/178 |
| 7,207,779 | B2 * | 4/2007 | Horng et al. | 416/186 R |
| 7,744,350 | B2 * | 6/2010 | Ogino et al. | 416/178 |
| 2006/0222491 | A1 * | 10/2006 | Shimada | 415/206 |

FOREIGN PATENT DOCUMENTS

| | | | |
|---|---|---|---|
| CN | 1172093 | C | 10/2004 |
| CN | 2775357 | Y | 4/2006 |

* cited by examiner

*Primary Examiner* — Nathaniel Weihe
(74) *Attorney, Agent, or Firm* — Altis Law Group, Inc.

(57) ABSTRACT

An impeller (10) of a cooling fan includes a hub (11) and a plurality of blades (12) radially and outwardly extending from the hub. Each of the blades includes a windward surface (127) and a leeward surface (128). A groove (124) is defined in each of the blades for guiding airflow from the windward surface to the leeward surface.

18 Claims, 4 Drawing Sheets

IMPELLER AND COOLING FAN INCORPORATING THE SAME

BACKGROUND

1. Technical Field

The present invention relates to cooling fans, and more particularly to an impeller which helps to decrease noise generated by a cooling fan incorporating the impeller.

2. Description of Related Art

It is well known that heat is produced by electronic components such as central processing units (CPUs) during their normal operations. If the heat is not timely removed, these electronic components may overheat. Therefore, heat sinks and cooling fans are often used to cool these electronic components.

Conventionally, a cooling fan includes a housing, a stator received in the housing and an impeller being rotatable with respect to the stator. The impeller includes a hub and a plurality of blades radially and outwardly extending from the hub. When the cooling fan operates, the blades of the impeller rotate around the stator to drive an airflow to flow towards an electronic component, thus cooling the electronic component continuously. Increasing revolving speed of the impeller relatively increases the amount of the airflow, therefore a heat dissipation efficiency of the cooling fan is relatively improved. However, increasing the revolving speed may correspondingly cause a rise of a noise level generated by the cooling fan, thus making a user near the fan feel uncomfortable.

There are two main forms of noise generated by the cooling fan. One is rotary noise, which is generated when the blades cut air. The rotary noise is based on a blade passing frequency (BPF) with superposition of high harmonic waves. The rotary noise will be increased due to a resonant chamber formed among the housing and every two adjacent blades of the impeller. The other one is vortex noise, which has a broad spectrum. When rotating, the impeller drives air to generate vortex, and a Karman vortex street is defined between every two adjacent blades of the impeller.

What is needed, therefore, is an impeller and a cooling fan incorporating the impeller which can overcome the above-mentioned disadvantage.

SUMMARY

The present invention, in one aspect, provides an impeller. In accordance with an embodiment of the present invention, the impeller includes a hub and a plurality of blades radially and outwardly extending from the hub. Each of the blades includes a windward surface and a leeward surface. A groove is defined in each of the blades for guiding airflow from the windward surface to the leeward surface.

The present invention, in another aspect, provides a cooling fan. In accordance with an embodiment of the present invention, the cooling fan includes an impeller. The impeller includes a hub and a plurality of blades radially and outwardly extending from the hub. Each of the blades includes a windward surface and a leeward surface. A groove is defined in each of the blades for guiding airflow from the windward surface to the leeward surface.

Other advantages and novel features of the present impeller and cooling fan will become more apparent from the following detailed description of preferred embodiments when taken in conjunction with the accompanying drawings, in which:

DETAILED DESCRIPTION

Figure 1:
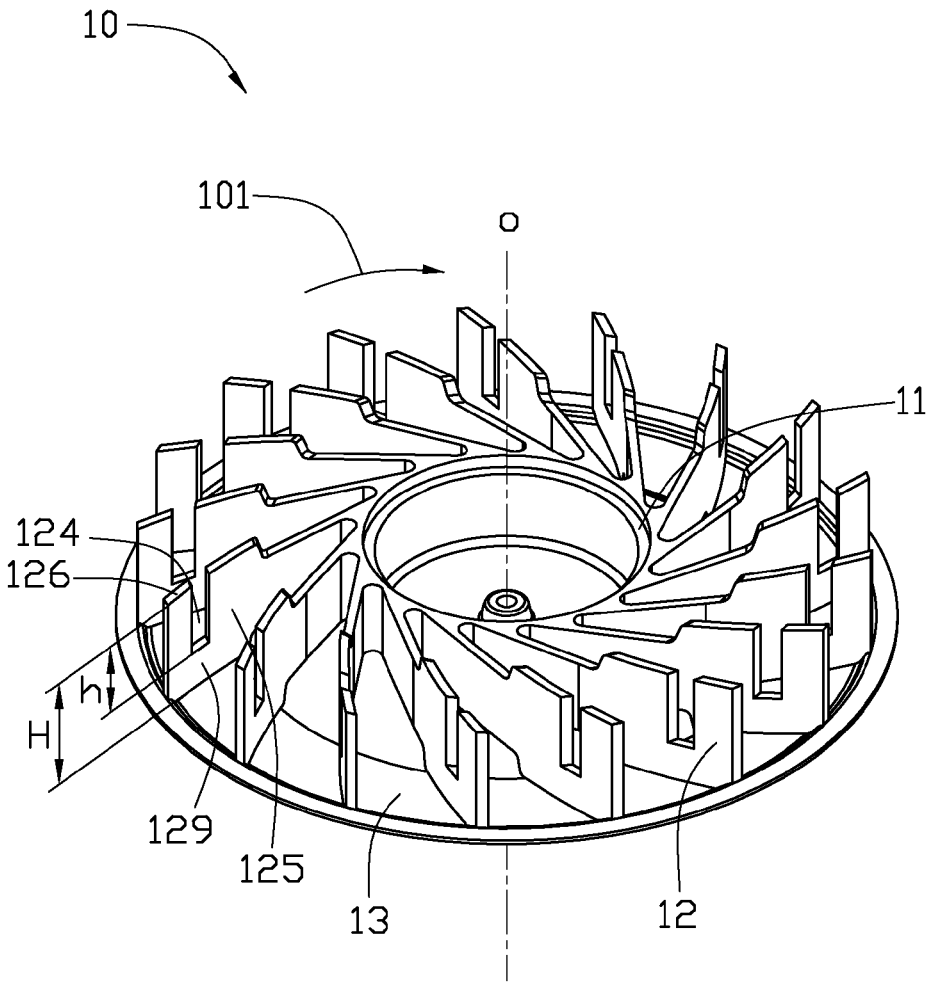
FIG. 1 is an isometric view of an impeller of a cooling fan in accordance with a first preferred embodiment of the present invention.
Figure 2:
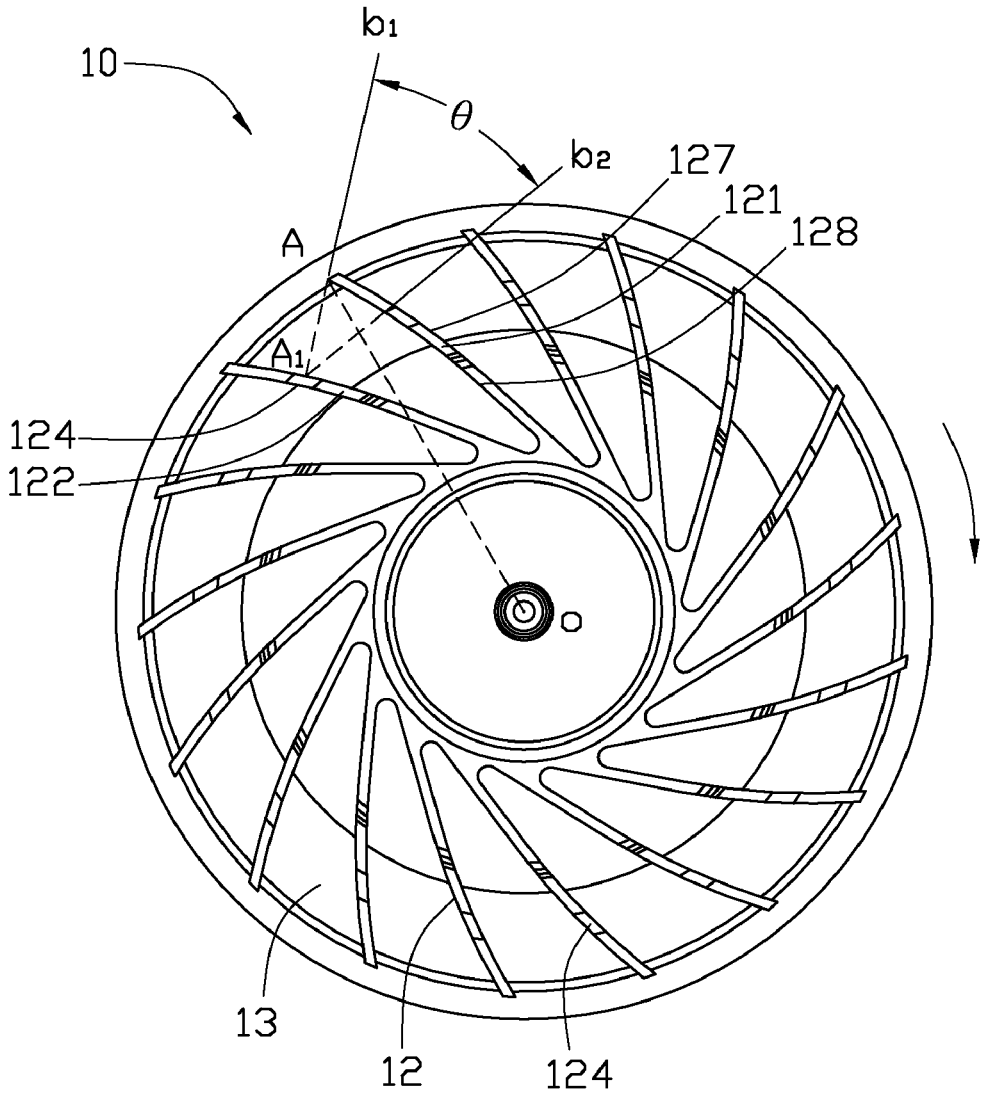
FIG. 2 is a top plan view of the impeller of FIG. 1.

Referring to FIGS. 1 and 2, an impeller 10 of a cooling fan in accordance with a first preferred embodiment of the present invention is shown. Besides the impeller 10, the cooling fan further includes a housing (not shown), a stator (not shown) received in the housing and a cover (not shown) covered on the housing. The impeller 10 is rotatable with respect to the stator and is received in the housing. The impeller 10 includes a hub 11, a plurality of blades 12 radially and outwardly extending from the hub 11 and a ring 13 fixed on the blades 12. Each of the blades 12 is extended inclinedly from the hub 11. When the impeller rotates along a clockwise direction as indicated by arrow 101, the impeller 10 generates an airflow.

The blades 12 each have a same configuration. A blade vertex A is defined at a tip of a front blade 121. The blade vertex A on the front blade 121 is a point which has a furthest distance from an axis O of the hub 11. A projective point $A_1$ is defined on a rear blade 122 via a projection of the blade vertex A of the front blade 121 on the rear blade 122. The projective point $A_1$ on the rear blade 122 is a point which has a closest distance from the blade vertex A of the front blade 121. A groove 124 is vertically defined in each blade 12 at the projective point $A_1$. A vertical height h of the groove 124 is smaller than a vertical height H of the blade 12. Namely, the groove 124 does not pass through the blade 12 along an axial direction of the impeller 10. The vertical height h of the groove 124 is greater than a half of the vertical height H of the blade 12 so as to increase a flux of the airflow passing through the groove 124. The groove 124 has a width in the range of from 0 mm to 5 mm, preferably from 0.5 mm to 1 mm, so as to achieve a suitable leakage of an airflow pressure of the airflow. The width of the groove 124 may be varied depending upon the requirements of intended wind pressure.

Each of the blades 12 has a windward surface 127 and a leeward surface 128. The groove 124 is defined along a rotating direction of the impeller 10 and inclinedly with respect to the windward surface 127 and the leeward surface 128. A projective line $b_1$ is defined by the projective point $A_1$ on the rear blade 122 and the blade vertex A of the front blade 121. A connecting line $b_2$ is defined by the groove 124 along the rotating direction. An acute angle θ is formed between the projective line $b_1$ and the connecting line $b_2$.

The groove 124 in the blade 12 divides the blade 12 into two parts. One part is a primary blade portion 125, which is located adjacent to the hub 11. The other part is a secondary blade portion 126, which is located apart from the hub 11. A connecting blade portion 129 is located under the groove 124 and interconnects the secondary blade portion 126 with the primary blade portion 125. The secondary blade 126 portion is on an extended line of the primary blade portion 125. In other words, the secondary blade portion 126 is aligned with the primary blade portion 125 along a radial direction from the hub 11.

Alternatively, the groove 124 can be defined in other positions along the blade 12. Since a majority of the airflow is generated by a free end of the blade 12 where the secondary blade portion 126 is located, the groove 124 is preferably defined in the free end of the blade 12, so as to achieve a suitable leakage of the airflow pressure. For example, the groove 124 is defined at a suitable point in the free end of the blade 12, wherein a distance between the blade vertex A and the suitable point is less than a half of a total length of the blade 12; that is, the groove 124 is defined in the outer half of the blade 12.

The ring 13 has an annular shape and is disposed at a position of the blades 12 where the grooves 124 are defined, so as to connect the primary blade portion 125 with the secondary blade portion 126 and increase a mechanical strength of the impeller 10.

In the present cooling fan, the grooves 124 in the blades 12 of the impeller 10 prevent a resonant chamber from being formed among the housing and every two adjacent blades 12 of the impeller 10 as much as possible, thus decreasing the rotary noise. In addition, the grooves 124 guide the airflow from the windward surface 127 to the leeward surface 128 of each of the blades 12, thereby ensuring that an airflow velocity at the windward side substantially equals an airflow velocity at the leeward side. Therefore, the grooves 124 can prevent the vortex from being generated as much as possible, so as to break the Karman vortex street as defined between every two adjacent blades 12 of the impeller 10 and decrease the vortex noise.

Figure 3:
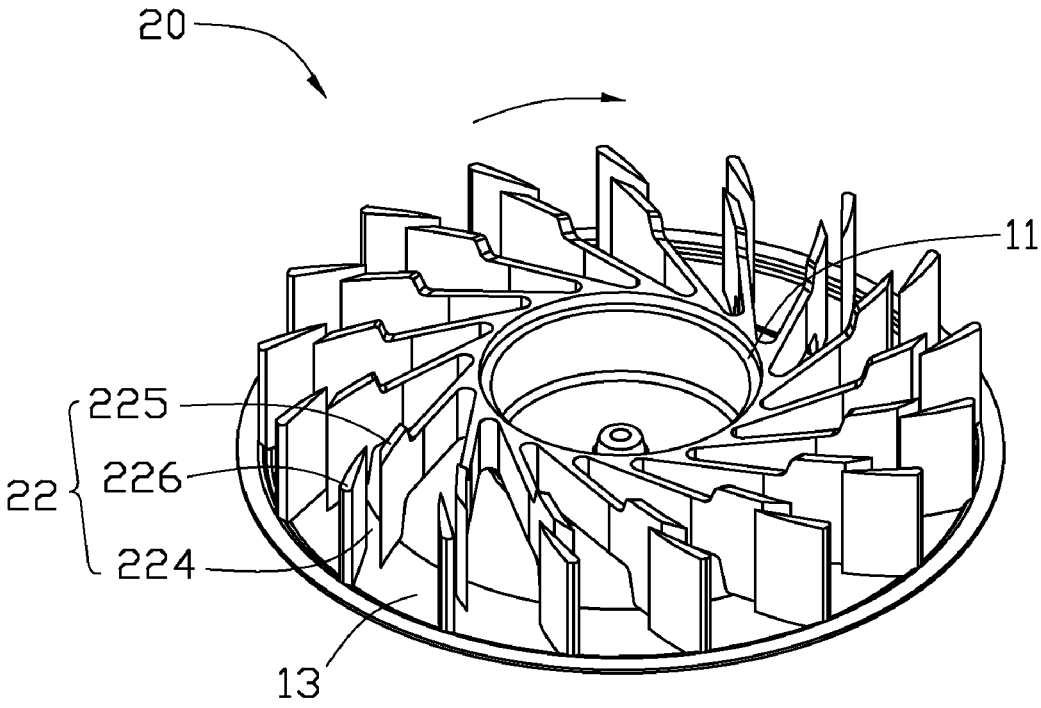
FIG. 3 is an isometric view of an impeller of a cooling fan in accordance with a second preferred embodiment of the present invention.
Figure 4:
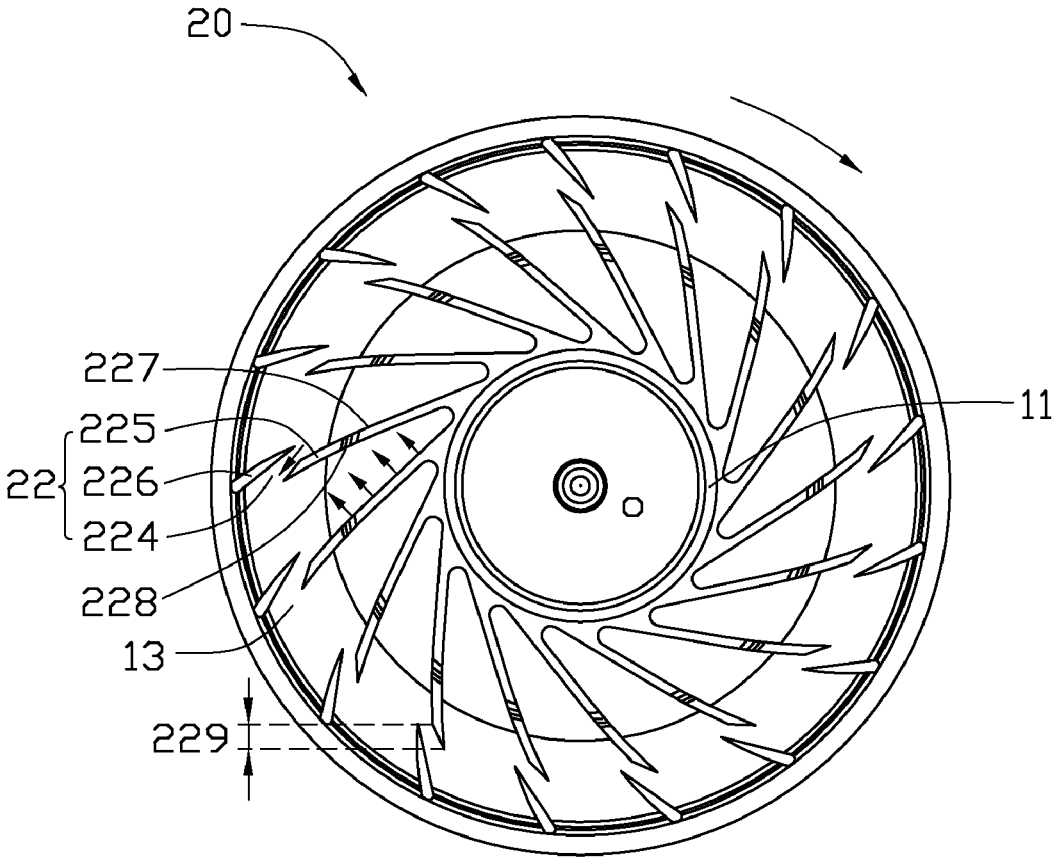
FIG. 4 is a top plan view of the impeller of FIG. 3.

Referring to FIGS. 3 and 4, an impeller 20 of a cooling fan in accordance with a second preferred embodiment of the present invention is shown. The impeller 20 is similar to the impeller 10 in the previous embodiment. In this embodiment, the primary blade portion 225 of each blade 22 is staggered from the secondary blade portion 226 of the same blade 22 by a certain angle. Namely, the secondary blade portion 226 is not on an extended line of the primary blade portion 225. The secondary blade portion 226 and the primary blade portion 225 are not aligned with each other. The secondary blade portion 226 offsets outwardly relative to the primary blade portion 225 so that the groove 224 is defined between the secondary blade portion 226 and the primary blade portion 225. The primary blade portion 225 and the secondary blade portion 226 are partially overlapped with each other so that an overlapping area 229 is formed. The overlapping area 229 formed between the primary blade portion 225 and the secondary blade portion 226 of the impeller 20 can increase a sweeping surface area for the airflow on the windward surface 227 of the blade 22. The groove 224 of each blade 22 is defined slantways with respect to the windward surface 227 and the leeward surface 228. The groove 224 passes vertically through the blade 22 along the axial direction of the impeller 20 and divides the blade 22 into the primary blade portion 225 and the secondary blade portion 226. In other words, a vertical height of the groove 224 equals to a vertical height of the blade 22. The primary blade portion 225 and the secondary blade portion 226 are connected together via the ring 13 attached to the blades 22.

The cooling fan in the previous embodiments may be an axial flow fan, a centrifugal fan, or other types of cooling fans.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An impeller comprising:

a hub; and a plurality of blades radially and outwardly extending from the hub, each of the plurality of blades comprising a windward surface and a leeward surface;

wherein a groove is defined in at least one of the plurality of blades for guiding airflow from the windward surface to the leeward surface; and wherein a blade vertex is defined at a tip of a front blade, and a projective point is defined on a rear blade via a projection of the blade vertex of the front blade on the rear blade, the groove being defined at the projective point.

2. The impeller as claimed in claim 1, wherein the groove is defined inclinedly with respect to the windward surface and the leeward surface.

3. The impeller as claimed in claim 1, wherein the groove has a width greater than 0 mm and not greater than 5 mm.

4. The impeller as claimed in claim 3, wherein the groove has a width in the range of from 0.5 mm to 1 mm.

5. The impeller as claimed in claim 1, wherein a height of the groove is smaller than a height of the blade where the groove is defined.

6. The impeller as claimed in claim 1, wherein a height of the groove is greater than a half of a height of the blade where the groove is defined.

7. The impeller as claimed in claim 6, wherein the groove passes through the blade along an axial direction of the impeller.

8. The impeller as claimed in claim 1, wherein the groove divides the blade into a primary blade portion adjacent to the hub and a secondary blade portion apart from the hub.

9. The impeller as claimed in claim 8, wherein the secondary blade portion is on an extended line of the primary blade portion.

10. The impeller as claimed in claim 8, wherein an overlapping area is formed between the primary blade portion and the secondary blade portion, the secondary blade portion offsetting outwardly relative to the primary blade portion.

11. The impeller as claimed in claim 8, wherein a connecting blade portion is located under the groove and interconnects the primary blade portion with the secondary blade portion.

12. The impeller as claimed in claim 8, wherein a height of the groove equals a height of the blade, and the primary blade portion and the secondary blade portion are connected together via a ring attached to the blades.

13. The impeller as claimed in claim 1, wherein a ring having an annular shape is fixed at a position of the blade where the groove is defined.

14. The impeller as claimed in claim 1, wherein the groove is defined in each of the blades.

15. The impeller as claimed in claim 1, wherein the groove is defined in an outer half of the blade.

16. A cooling fan comprising:

an impeller, wherein the impeller comprises a hub and a plurality of blades radially and outwardly extending from the hub, each of the plurality of blades comprising a windward surface and a leeward surface, a groove being defined in at least one of the plurality of blades for guiding airflow from the windward surface to the leeward surface; and wherein a blade vertex is defined at a tip of a front blade, and a projective point is defined on a rear blade via a projection of the blade vertex of the front blade on the rear blade, the groove being defined at the projective point.

17. The cooling fan as claimed in claim 16, wherein the groove divides the blade into a primary blade portion adjacent to the hub and a secondary blade portion apart from the hub.

18. The cooling fan as claimed in claim 16, wherein a height of the groove is greater than a half of a height of the blade.

* * * * *